US010902826B1

(12) United States Patent
Brock

(10) Patent No.: US 10,902,826 B1
(45) Date of Patent: Jan. 26, 2021

(54) SOUNDBOARD AND MODULAR INSTRUMENT

(71) Applicant: Brian Brock, Laveen, AZ (US)

(72) Inventor: Brian Brock, Laveen, AZ (US)

( * ) Notice: Subject to any disclaimer, the term of this patent is extended or adjusted under 35 U.S.C. 154(b) by 0 days.

(21) Appl. No.: 16/682,079

(22) Filed: Nov. 13, 2019

(51) Int. Cl.
*G10D 3/02* (2006.01)
*G10D 3/22* (2020.01)

(52) U.S. Cl.
CPC ..... *G10D 3/02* (2013.01); *G10D 3/22* (2020.02)

(58) Field of Classification Search
CPC ..... G10D 3/02
See application file for complete search history.

(56) References Cited

U.S. PATENT DOCUMENTS 243,073 A * 6/1881 Kopp ..... G10D 3/02 84/275
451,863 A * 5/1891 Springer ..... G10D 1/085 84/292
552,555 A * 1/1896 Thompson ..... G10D 3/02 84/275
2,098,701 A * 11/1937 Cox ..... G10D 3/02 84/267
3,233,495 A * 2/1966 Bernardi ..... G10D 3/02 84/294
3,494,241 A * 2/1970 Jones, Sr. ..... G10D 3/02 84/307
3,523,479 A * 8/1970 Ludwig ..... G10D 3/02 84/274
3,722,345 A * 3/1973 Dopera ..... G10D 3/02 84/291
4,433,603 A 2/1984 Siminoff
5,945,614 A 8/1999 White
6,376,755 B1 4/2002 Kammerer
6,911,590 B2 6/2005 Childress
8,294,010 B2 * 10/2012 Gillett ..... G10D 3/02 84/291
9,165,539 B2 * 10/2015 Ostosh ..... G10D 1/085
9,406,285 B2 * 8/2016 Soga ..... G10D 3/00
9,697,807 B2 * 7/2017 Brown, Jr. ..... G10H 1/32
9,852,718 B1 * 12/2017 Kelly ..... G10D 3/02
9,916,818 B1 * 3/2018 Howie ..... G10D 3/02
2016/0372089 A1 * 12/2016 Tully ..... G10H 1/32

FOREIGN PATENT DOCUMENTS

DE 102011052320 1/2012

* cited by examiner

*Primary Examiner* — Robert W Horn
(74) *Attorney, Agent, or Firm* — Ohlandt, Greeley, Ruggiero & Perle, LLP

(57) ABSTRACT

A modular musical device comprising a removable soundboard.

35 Claims, 8 Drawing Sheets

SOUNDBOARD AND MODULAR INSTRUMENT

DESCRIPTION OF RELATED ART

Current manufacturing techniques for musical instruments require that the instrument be manufactured all at once. A problem with conventional guitars and other lute-type instruments is that they must be constructed with requisite structural soundness to last many years. This often results in overbuilding, where the soundboard is not as free to vibrate in an acoustically ideal manner. Yet every action taken to lighten a given soundboard to make it livelier and acoustically vibrant sacrifices and weakens the structural integrity of instrument.

The difficulty repairing conventionally constructed guitars and lute-type instruments, is that they also require the builder to build the instruments so that repairs are unnecessary, which can result in an acoustically inferior instrument (e.g.: when braces are built so that they are held in place by the sides of the instrument).

Another problem with existing guitars, violins, and other lute-type instruments is that the soundboard is glued and permanently affixed onto the body of the instrument, such that removal for repair or replacement requires extensive work to break the glue joint, followed by difficulty in replacement, as the old glue must be removed so that new glue will stick well. Furthermore, decorative or structural elements which may be present at the junction between soundboard and body frame often must be destroyed in the process of removal.

Further, as lute-type musical instruments are permanently assembled during manufacture, adjusting internal elements in the body of the instrument to modify the sound for tuning and finishing is only possible by reaching in through a soundhole in the soundboard with tools, which requires working in the dark and at physically awkward angles.

SUMMARY

In an embodiment, described is a modular musical device comprising: a body; a soundboard; and a rim around a perimeter of an underside of the soundboard, wherein the rim is configured to allow the rim and soundboard to detach from the body of the musical device.

In an embodiment, described is a soundboard for a musical instrument comprising: a soundboard plate; and a rim around a perimeter of an underside of the soundboard plate, wherein the nm is configured to allow the soundboard to detach from a body of a musical instrument.

In an embodiment, described is a body for a musical instrument comprising: a lower body comprising an attachment mechanism configured to attach and detach a detachable soundboard.

In at least one of the various embodiments, the rim can comprise an attachment mechanism for attaching and detaching the soundboard from the body. The attachment mechanism can comprise fasteners selected from the group consisting of: nuts and bolts, buckles, magnets, pins, tabs and slots, and clamps. The rim can comprise a material selected from the group of: wood, metal, medium-density fibreboard, plastic and carbon fiber.

In at least one of the various embodiments, the attachment mechanism can comprise nuts and bolts, and the musical device can further comprise: a plurality of bolt holes distributed along a frame of the body; and a plurality of corresponding nuts distributed in the rim of the soundboard.

The bolt holes can be configured to allow the plurality of bolts to extend from a top of the instrument body to a bottom part of the instrument body. The bolt holes can be configured to allow the plurality of bolts to extend through a frame from a top part of the instrument body to a bottom part of the instrument body. The instrument can further comprise the bottom part being attached to the frame on the opposite side from the soundboard, wherein the bottom part is configured to detach from the frame of the musical device.

In at least one of the various embodiments, the attachment mechanism can comprise a plurality of bolts distributed along the rim of the soundboard and a plurality of corresponding nuts distributed in a frame of the body.

In at least one of the various embodiments, the attachment mechanism can comprise a plurality of buckles configured to buckle the rim and soundboard to a frame of the body.

In at least one of the various embodiments, the attachment mechanism can comprise a plurality of angled tabs distributed along the rim of the soundboard; and a plurality of mating slots distributed along a frame of the body.

In at least one of the various embodiments, the musical instrument can further comprise: a frame of the body. In an embodiment, the perimeter of the soundboard can form the rim of the soundboard, and the musical instrument, and rim reinforcement for the rim of the soundboard is provided by another rim formed on the frame of the musical instrument. In another embodiment, the rim on the underside of the soundboard is mountable on the other rim formed on the frame.

In at least one of the various embodiments, a rim formed on the frame of the musical instrument can form a side of the instrument body. The rim of the soundboard can be configured to be mounted directly on a frame of the body of the musical device.

In at least one of the various embodiments, the instrument can further comprise a bottom part attached to the body on the opposite side of the soundboard, wherein the bottom surface is configured to detach from the musical device.

In at least one of the various embodiments, the rim can be formed integrally with the soundboard.

In at least one of the various embodiments, the rim can be formed separately from the soundboard and attached thereto.

In at least one of the various embodiments, the musical instrument is a lute type instrument. The lute type instrument can be selected from one of the group of: a guitar, a violin, a viola, a cello, a banjo, and a lute. In an embodiment, the rim can have a width extending from the side of the perimeter of the soundboard up to about 2 inches or more and a thickness extending perpendicularly from the soundboard up to about 1 inch or more.

In at least one of the various embodiments, the rim has a width and a thickness configured to provide structural stiffness to allow the center of the soundboard to vibrate.

DETAILED DESCRIPTION OF EMBODIMENTS

Figure 1A:
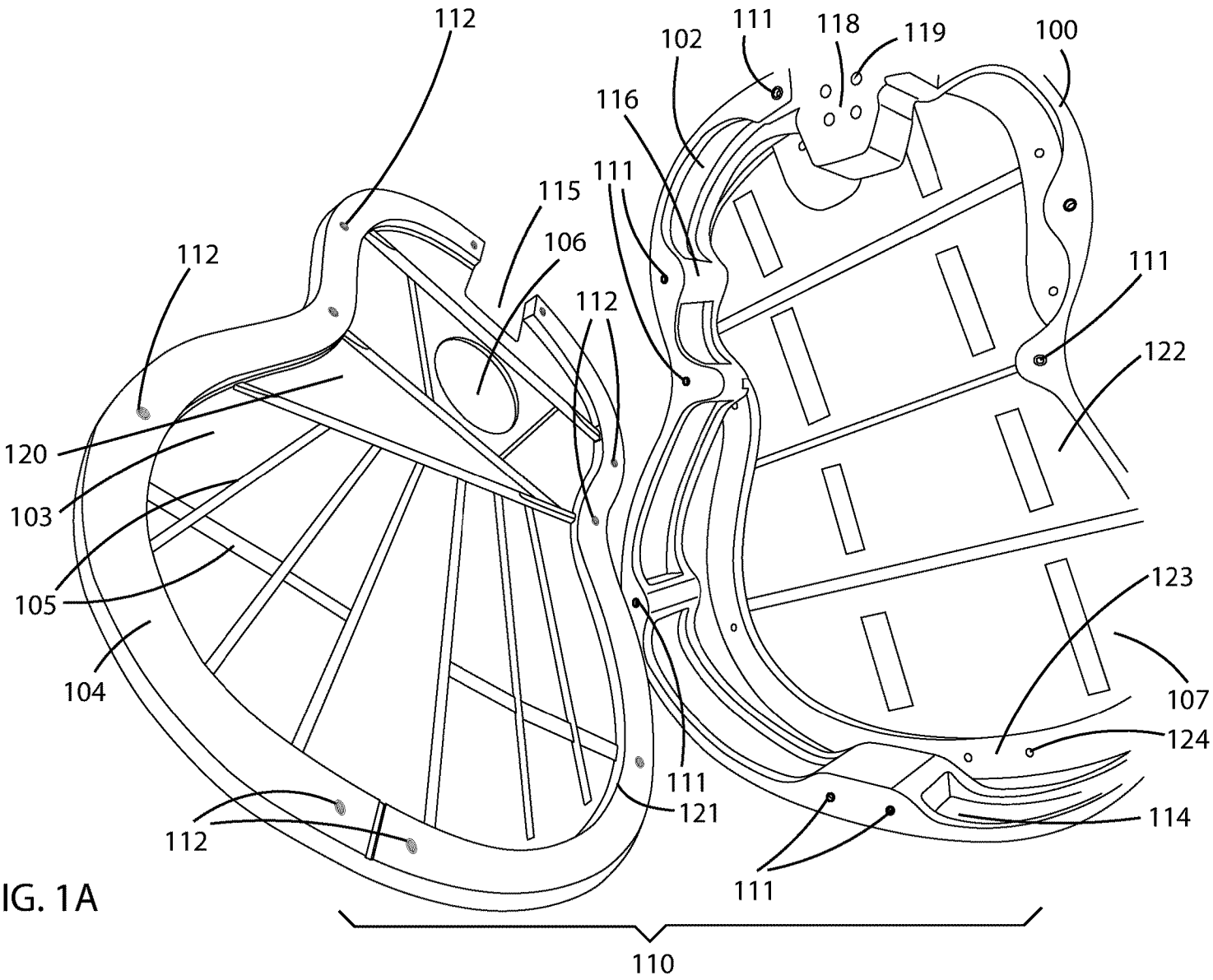
FIG. 1A shows a plan view of a first embodiment of a musical device.

Various embodiments now will be described more fully hereinafter with reference to the accompanying drawings, which form a part hereof, and which show, by way of illustration, specific embodiments by which the invention may be practiced. The embodiments may, however, be embodied in many different forms and should not be construed as limited to the embodiments set forth herein; rather, these embodiments are provided so that this disclosure will be thorough and complete, and will fully convey the scope of the embodiments to those skilled in the art.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art informed by the teachings of this disclosure will recognize that other elements are desirable for implementing the present invention. However, because such elements are well known in the art, and because they do not facilitate a better understanding of the present invention, a discussion of such elements is not provided herein.

Throughout the specification and claims, the following terms take the meanings explicitly associated herein, unless the context clearly dictates otherwise. The term "herein" refers to the specification, claims, and drawings associated with the current application. The phrase "in an embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention. In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Embodiments of musical instruments as described herein refer to musical instruments comprising soundboards, including lute-type instruments such as guitars, the violin family, and other instruments including one or more plates attached to and forming an instrument body having sides to which a neck may also be attached.

The present invention will now be described in detail on the basis of exemplary embodiments.

FIGS. 1A-1B and 2A-2C show embodiments of a musical device 100. In the embodiments of FIGS. 1A-1B and 2A-2C, the musical device 100 is a lute type of device, namely a guitar. The musical device 100 comprises a frame 102, a soundboard 103, and a rim 104 around the perimeter of the underside of soundboard 103, wherein the rim 104 is configured to allow the rim and soundboard detach from the frame of the musical device. A plurality of braces 105 extend between interior sides 121 of the rim 104 along the underside 121 of the soundboard 103. The soundboard 103 comprises an opening forming a soundhole 106. The musical instrument 100 includes a bottom plate 107 forming a bottom part 107 of a body 110 of the musical instrument 100 attached to the underside of the frame 104 opposite the soundboard 103 on forming a top part of the musical instrument 100. The soundboard 103, the frame 102, and bottom part 107 thus form a body 110 of the musical instrument, with the frame 102 forming the sides of the musical instrument 100 body 110. The musical instrument 100 is further constructed to include the rim 104 around the perimeter of the underside of soundboard 103, which provides many advantageous features, including those described herein.

The rim 104 is configured such that the soundboard maintains flexibility in an active area of the soundboard 103, while at the same time is sufficiently thick to provide stability. The rim 104 has a width and a thickness configured to provide structural stiffness while still allowing the center of the soundboard to vibrate. The rim 104 is also configured to provide attachment points at the edges of the soundboard 103. The rim 104 can be composed of a material that provides stiffness to the thin soundboard 103 while also providing a mounting area for attachment mechanisms as described herein.

For example, for a guitar or other lute-type musical instrument 100, the rim 104 can have a width extending from the side of the perimeter of the soundboard at to about 2 inches or more, and can have a thickness extending perpendicularly from the soundboard at to about 1 inch or more. In the embodiments of the musical instrument shown in FIGS. 1A-1B and 2A-2C, the rim 104 affixed under the soundboard 103 is about 1 inch wide and 0.5 inches thick.

In other embodiments, the soundboard can be of sufficient stiffness that rim 104 of the soundboard 104 can serve as a mounting area for attachment mechanisms with little or no additional reinforcement material. For example, the musical instrument soundboard 103 can be of sufficient thickness and stiffness at the perimeter such that attachment mechanisms can be formed into it or added directly thereto, thus the perimeter of the soundboard 103 itself forms the soundboard rim 104. As will be appreciated, in such embodiments, rim reinforcement can be provided by the instrument body 110 or frame 102 where the soundboard 103 joins the body 110 or frame 102, for example by a rim 114 formed on the frame 102. In other embodiments, the rim of the musical instrument 100 can be formed such that additional reinforcement is added along portions of the rim 104 of the soundboard 103 or at the body 110 or frame 102 where the soundboard 103 is joined, for example at the attachment points. Accordingly, a reinforced rim structure for the modular soundboard 103 can be provided by reinforcing any of the soundboard 103 rim 104, the body 110 or frame 102 rim 114, or at attachment points of either or both, or any combination thereof.

The rim 104 is configured such that the soundboard can properly function while providing the additional advantage of modularity to the musical instrument 100. Factors such as the size of the instrument, the surface area of the soundboard 103, and the choice of instrument manufacturing material can be balanced to achieve an optimal configuration or acceptable trade-offs fora particular musician or musical instrument 100. As will be appreciated by skilled artisans informed by the teachings of this disclosure, varying the thickness, width, and composition of the rim 104 can allow for different balances of structural and acoustic factors. In embodiments, a rim 104 material can include wood of any species, various metals, plastics, and various composite materials such as medium-density fiberboard (MDF), carbon fiber, or any combination thereof.

For example, as noted herein, the center area of the soundboard 103 needs to be free to vibrate. In an embodiment, a thick and wide rim 104 composed of a dense substance can allow for a minimum of vibration loss from the soundboard due to edge vibration and can permit a highly secure attachment to the body 110. However, heavy or large rims 102 may pose a burden to a player of the instrument. Accordingly, for a smaller instrument, the rim 104 can be composed of a denser material, for example a plastic or carbon fiber laminate or medium-density fiberboard (MDF), whereas a larger instrument can have a rim 104 made of a lighter, less dense hardwood. That said, a larger instrument could nonetheless be composed of a denser material for musicians that prefer structural stiffness at the edges of the soundboard 103 over light weight. The rim 104 advantageously allows flexibility in overall musical quality, design, and acceptable trade-offs for the musical instrument 100 while providing modularity and ease of access.

Figure 3:
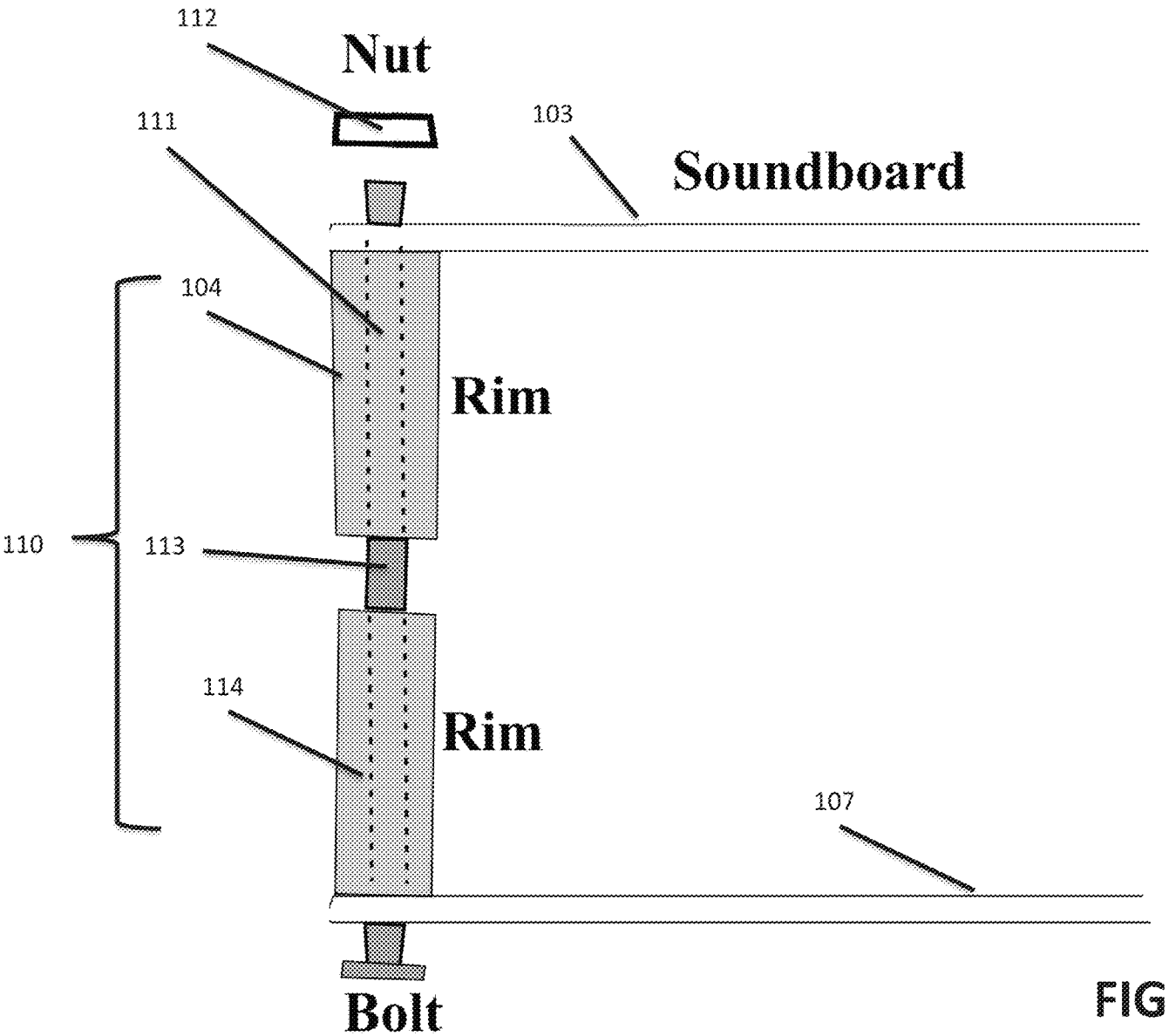
FIG. 3 shows a side cross section of an embodiment of the musical device.

In an embodiment, the rim 104 can be configured with a thickness that extends perpendicularly to the soundboard 103 such that it forms a portion of the side of the instrument body 110. In another embodiment, as shown in FIG. 3, a top surface soundboard 103 rim 104 thickness and bottom surface 107 rim 114 thickness can be configured to be attached directly attached to one another, for example by a bolt 113 extending through bolt holes 111 of the top surface soundboard rim 104 and the bottom surface rim 114, to form the sides of the musical instrument body 110. As shown in FIG. 3, this embodiment dispenses with the need for a separate body frame 102 for the body 110.

In another embodiment, a rim 104 can be installed in the sides or frame 102 of the instrument 100 to provide a mounting surface and attachment points, or various attachment points may be affixed directly to the sides of the instrument, as described in more detail below.

The rim 104 comprises an attachment mechanism for attaching and detaching the soundboard from the musical instrument. In an embodiment, the soundboard 103 can be attached to the frame 102 of the musical instrument 100 with a plurality of fasteners 108. The fasteners 108 can be distributed along the rim 104 that forms a perimeter at the underside of the soundboard 103.

For example, in an embodiment, the fasteners 108 can comprise nuts and bolts. The musical device 100 can comprise, for example a plurality of bolt holes 111 in ribs distributed along the frame 102 and a plurality of corresponding mating nuts 112 distributed in the rim of the soundboard. In an embodiment, the nuts 112 can be installed in the soundboard 103 and rim 104 assembly, with corresponding bolt holes 111 in the instrument body.

The instrument 100 further comprises a bottom part 107 attached to the frame 102 on the opposite side of the soundboard 103. In an embodiment, the bottom part can be permanently affixed to the frame 102, for example using glue, as shown in the embodiments of the musical instrument shown in 2A-2C.

Figure 1B:
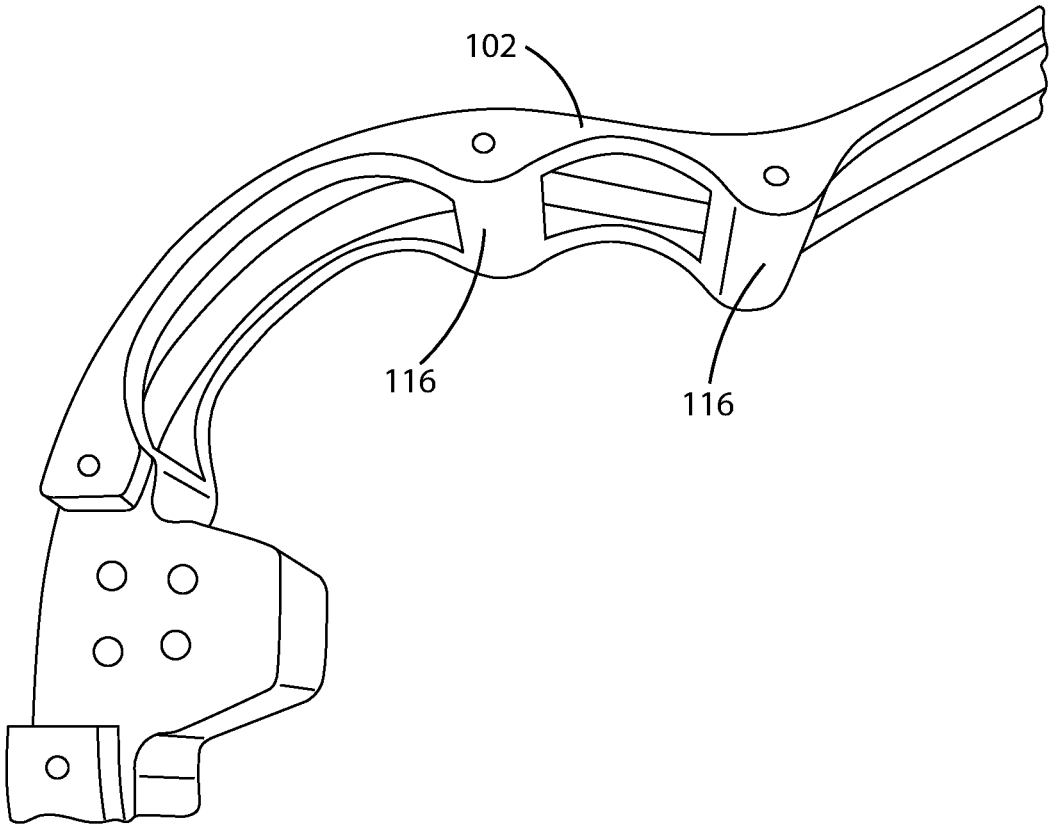
FIG. 1B shows a plan view of a frame of the first embodiment musical device.

In another embodiment, the bottom part 107 can be configured to detach from the frame of the musical device. For example, as shown in the embodiment of FIGS. 1A-1B, the bottom part 107 can comprise a plate 122 and another, bottom plate rim 123 similar in design to the soundboard 103 and soundboard rim 104, though it need not be. The bottom plate 122 rim 123 can include attachment points that fasten to the bottom of the frame 102 in a manner similar to that as the soundboard 103 and soundboard rim 104.

As shown in FIGS. 1A-1B, the frame 102 can include bolt holes 111 that extend from a top surface of the frame 102 of the instrument body 103 to the bottom part of the instrument body 103. Bolts 113 may then extend completely through the body 103 to the attachment points 124 in the rim 123 in the bottom plate 122, allowing both the back, bottom part 107 and the top, soundboard of the instrument 100 to be detached and removed.

Figure 2A:
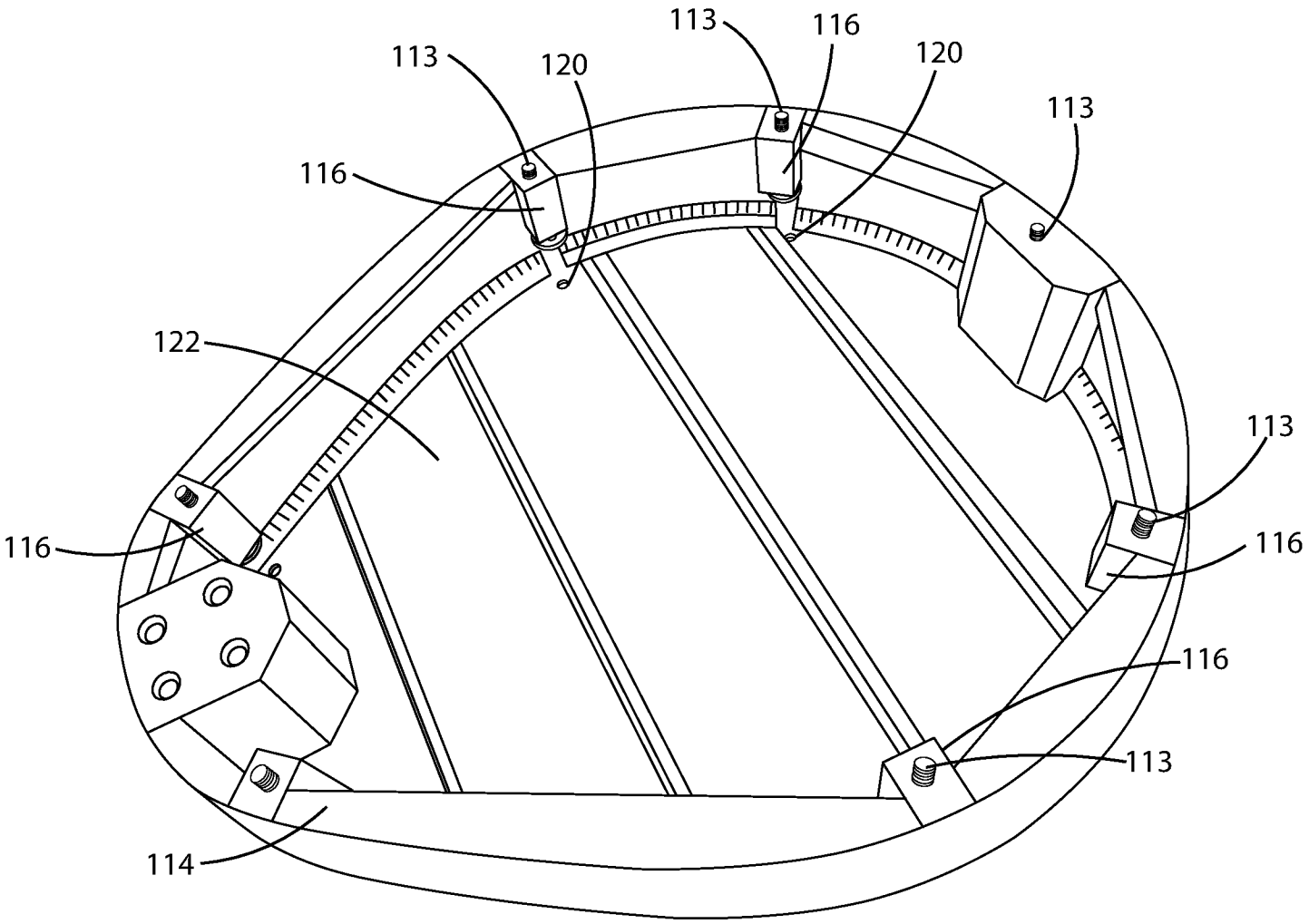
FIG. 2A shows a plan view of a second embodiment of the musical device.
Figure 2B:
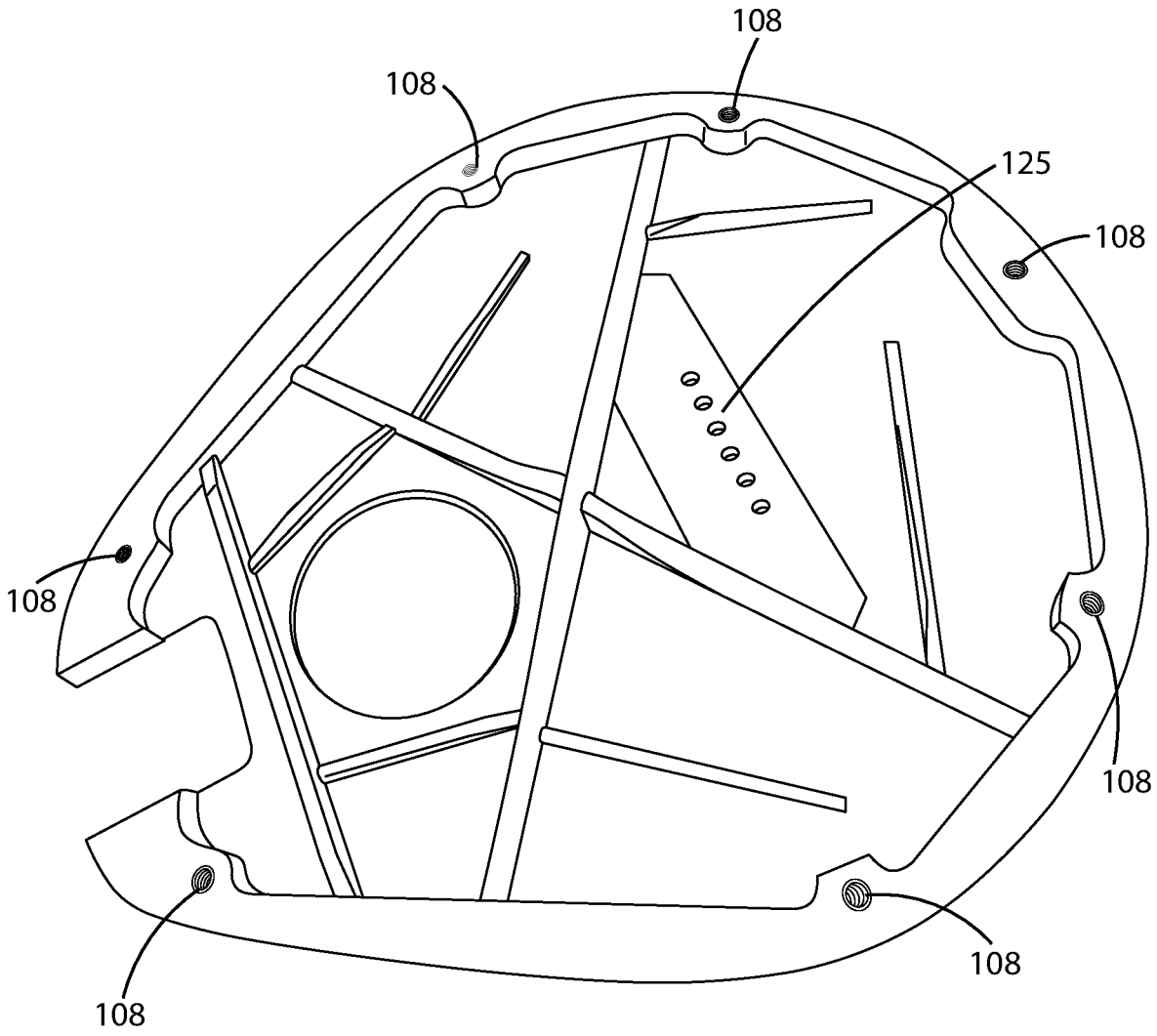
FIG. 2B shows a plan view of a frame and bottom surface of the second embodiment of the musical device.
Figure 2C:
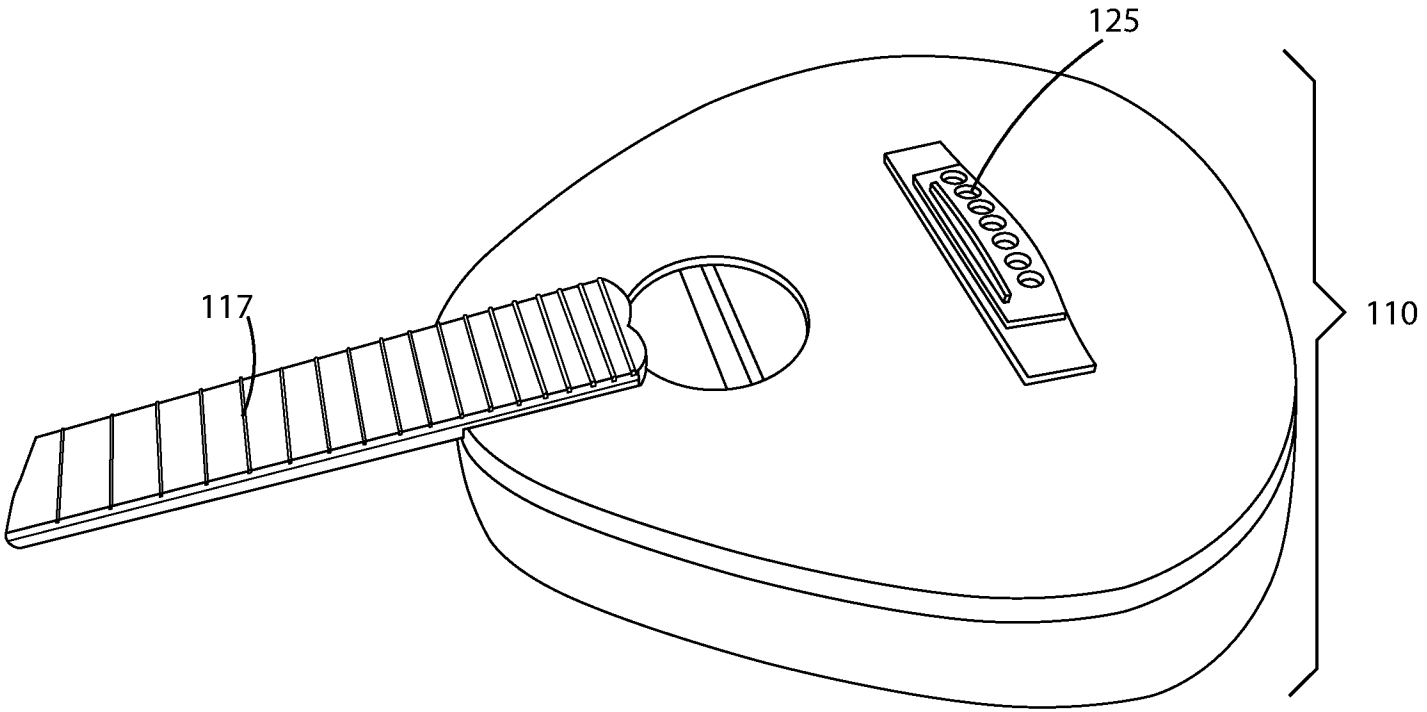
FIG. 2C shows a plan view of the second embodiment of the musical device.

As shown in the embodiment of FIG. 2A, bolt attachment points can also be contained inside the instrument 100. For example, the attachment mechanism can include a plurality of ribs 116 distributed along the perimeter of the body 110 of the instrument, where each of the ribs 116 have bolt holes 111. As shown in FIG. 2A, a plurality of ribs 116 distributed internally along the sides of the body 110 extend from the top frame 114 of the body and partially into a cavity musical instrument, such that the ribs 116 and bolts 113 are floating and do not extend to the bottom plate 122. The bolts are thereby installed internally in the musical instrument 100. The bolts 113 can accessed by holes 120 in the bottom plate 122 configured to allow a tool to access the internal bolts for soundboard removal.

In an embodiment, the nuts 112 may be positioned in cavities 112 within the rim, covered by or in the soundboard 103, so that from the outside the fasteners are concealed by soundboard 103 and the musical instrument 100 appears conventional.

In another embodiment, the fasteners for attaching and detaching the soundboard 103 can comprise a plurality of bolts distributed along the rim 104 of the soundboard 103 and a plurality of corresponding nuts distributed in the frame 102. For example, the nuts may be contained in the frame 102, while the bolts are either permanently affixed in or can pass through the soundboard 103 and the rim 104.

Figure 4A:
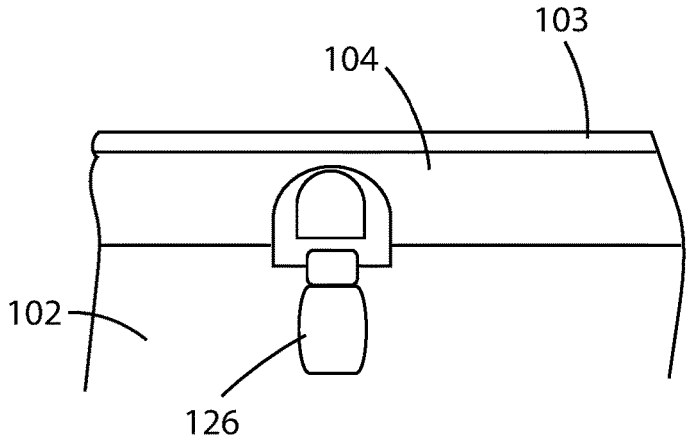
FIGS. 4A-4C show an embodiment of an attachment mechanism of the musical device.
Figure 4B:
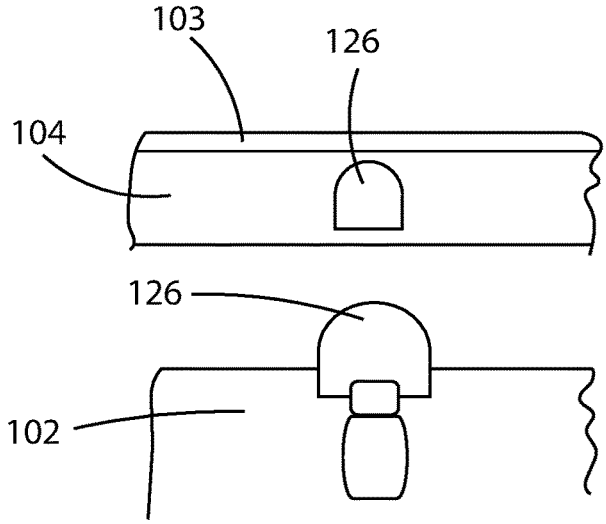
Figure 4C:
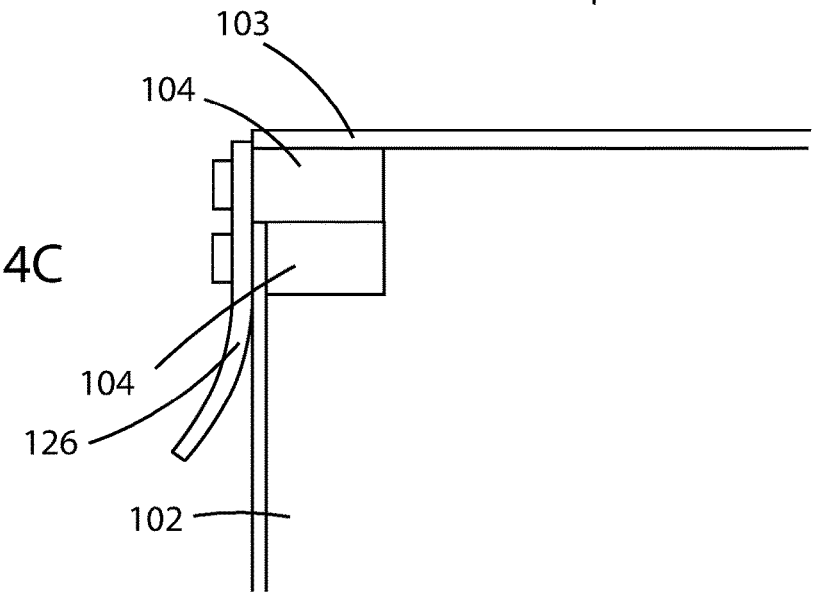

In another embodiment, as shown in FIGS. 4A-4C, the attachment mechanism can comprise a plurality of buckles 126 configured to buckle the rim 104 and soundboard 103 to the frame 102 of the instrument 100. For example, buckles 126 similar to those used to close suitcases or instrument cases can be installed on the rim 104 and body 110 of the instrument, which allow for easy attachment and detachment of the soundboard 103 and rim 104 assembly.

In another embodiment, external bolts 113 can be used, acting as clamps. For example, clamps can be used to temporarily hold a soundboard 103 to a body 110 of the instrument 100.

Figure 5:
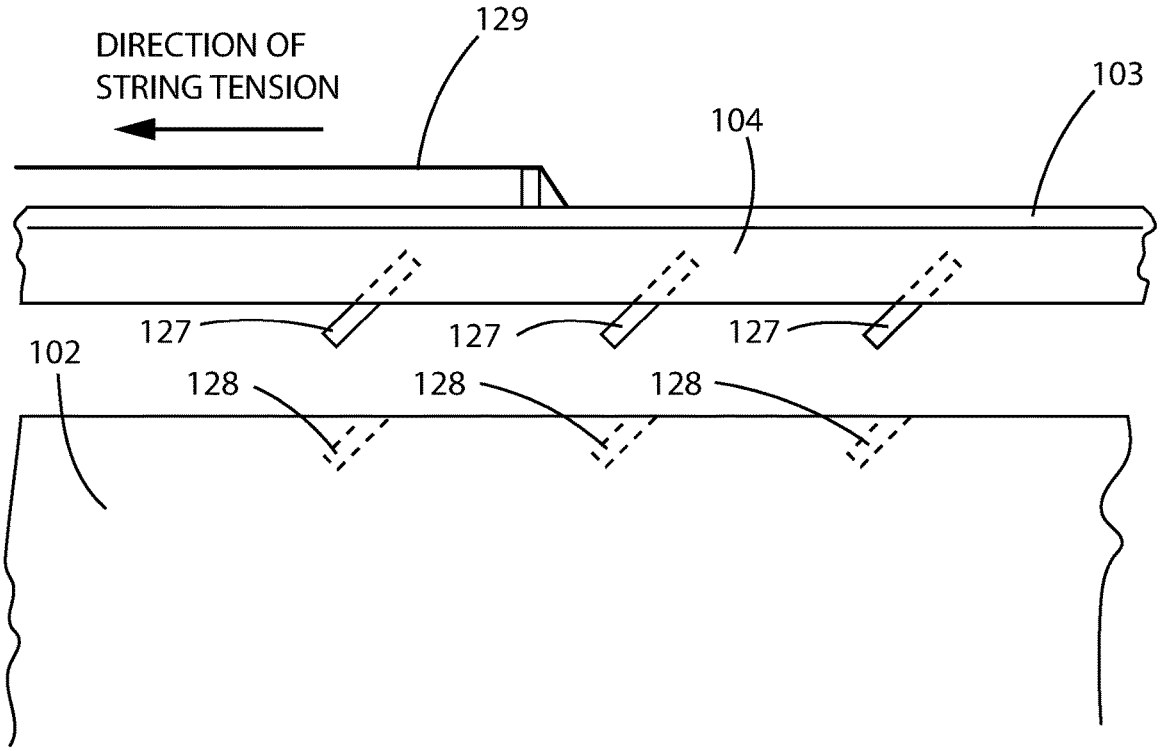
FIG. 5 shows an embodiment of an attachment mechanism of the musical device.

In another embodiment, as shown in FIG. 5, the attachment mechanism can comprise a plurality of angled tabs 127 distributed along the rim 104 of the soundboard 103 and a plurality of mating slots 128 distributed along the frame 102 of the musical device. As shown in FIG. 5, the vector of string tension of the strings 129 of the musical instrument keeps the soundboard 103 tensioned down and locked to the frame 102 of the body 110.

Figure 6:
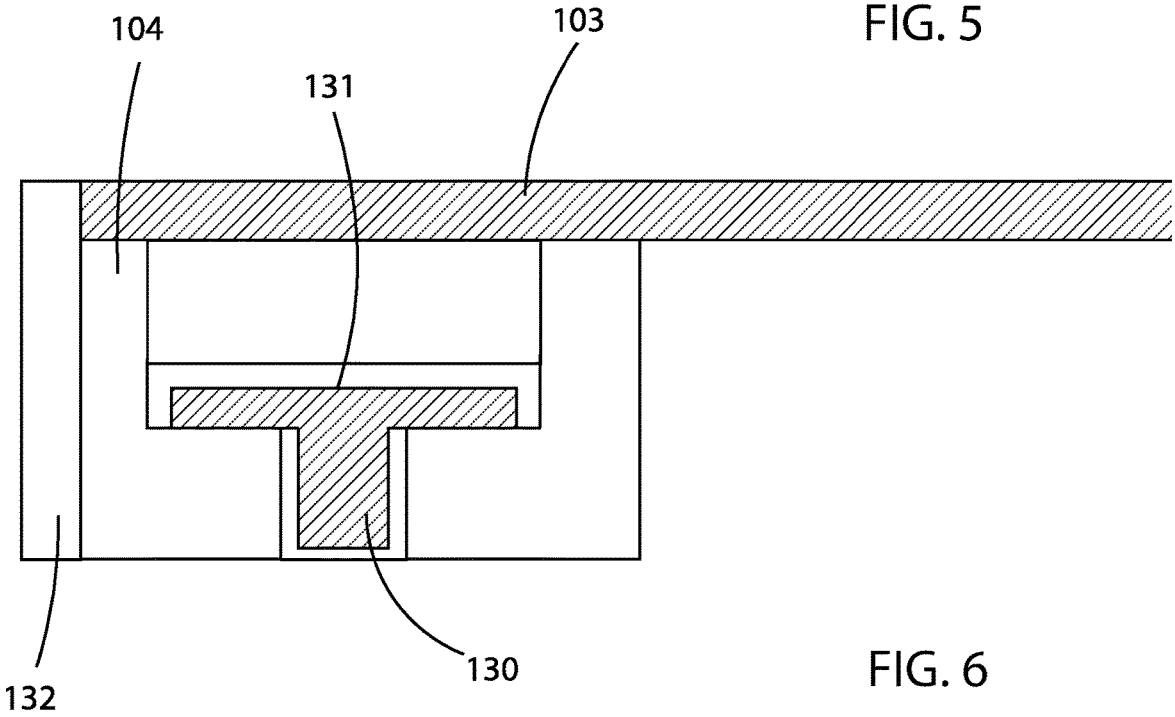
FIG. 6 shows an embodiment of an attachment mechanism of the musical device.

In another embodiment, as shown in FIG. 6, the attachment mechanism can comprise a t-nut 130 embedded in a pocket 131 of the rim, which is then plugged. A veneer 132 covers the rim and the soundboard on the side for a pleasing aesthetic that covers the attachment mechanism.

As will be appreciated, where fasteners are distributed about the perimeter of the soundboard, the attachment points are positioned at discrete locations around the instrument 100 perimeter. If attachment points are excessively far apart, vibration of the free rim between points can result in sound volume loss or tonal change. Accordingly, attachment points can be positioned at points of maximum stress, such as in the area to the sides of and behind a bridge 125 of the instrument 100, to maximize effectiveness and sound quality.

In an embodiment, the attachment mechanism can be a substantially continuous attachment mechanism. For example, the attachment mechanism can include a magnet attachment device, where strong magnets can be placed continuously along the rim 104 and a mating surface of the frame 102.

In another embodiment, given an appropriate body 110 shape, a set of matching channels can be installed on the inside of the soundboard rim 104 and the outside of the body frame 102. The matching channels can be threaded, that is, respectively cut and angled into the entire perimeter of the rim 104 and the frame 102 such that the soundboard 103 can be slid into a locking position, thereby held in place by string tension.

As will be appreciated, the attachment mechanism can include attachment mechanisms and fasteners and various combinations thereof other than those described above.

In embodiments, the rim 104 and soundboard 103 include an opening 115 to allow a neck 117 of the musical instrument to be affixed to the frame 102 at a neck joint 118. The neck joint includes an attachment mechanism similar to those described above, for example, bolt holes 119 configured to accept bolts installed a neck 117. Thus, the neck 117 of the musical instrument can also be configured to attach and detach from the body 110 of the instrument 100, resulting in a modular neck 117. In other embodiments, the neck and soundboard can be constructed integrally, and the neck and soundboard assembly can be configured to detach and attach as a unit using the removable soundboard construction as described herein.

In an embodiment, the musical device further comprises another rim 114 formed on the frame 102 of the musical instrument 100, wherein the rim 104 on the underside of the soundboard 103 is mountable on the rim 114 formed on the frame 102. Inan embodiment, the rim 114 formed on the frame 102 of the musical instrument 100 can forma side of the instrument body 110.

In an embodiment, the soundboard 103 rim 104 is configured to be mounted directly on the frame 102 of the musical device 100.

In an embodiment, the rim 104 can be formed separately from the soundboard 103 and attached thereto, for example by adhesive, or when attached by fasteners as described herein.

In another embodiment, the rim 104 can formed integrally with the soundboard 103. For example, rather than a separate rim 104, the soundboard 103 and rim 104 apparatus can be integrally formed as one unit. For instance, the soundboard 103 and rim 104 can be composed of a carbon fiber resin that is formed so that the outer edge has the shape and function of the nm. In another example, a single piece of wood can be carved or worked into the appropriate shape to form a soundboard 103 and rim 104, with bolt holes reinforced as necessary for the stresses of attachment. As noted above, the rim 104 is configured such that the soundboard 103 maintains flexibility in an active area of the soundboard 103 while thickening to provide stability and attachment points at the edges of the soundboard 103.

In embodiments, as the soundboard 103 and rim 102 are configured to be detachable and removable, the modular soundboard can be considered "disposable" or designed for a shorter life that the rest of the musical instrument 100. For example, the rim 102 and soundboard 103 can be composed of a very light, low-density material for a light, and lively soundboard. When the soundboard collapses or degrades under string tension, the modular soundboard can be replaced with a new soundboard.

Similarly, because the soundboard 103 and rim 102 are configured to be detachable and removable, the modular soundboard 103 can be switched out for another modular soundboard 103 on the same musical instrument 100. Thus, the same instrument 100 can have multiple, modular soundboards 103 for different acoustic or aesthetic properties.

Indeed, embodiments as described herein include musical instruments 100 where the necks 117, bodies 110, soundboards 103, and back parts 107 are modular and can each be manufactured independently, provided with standardized attachment points and mechanisms, and then provided separately.

Another advantage of a modular soundboard is that the soundboard module can be configured to integrate with instrument components for any instrument that employs a soundboard. For example, the soundboard can be configured to be a soundboard module for a mbira (thumb piano), hand drum, or other percussive instrument that is configured to use an instrument body for resonance.

One exemplary advantage of the modular construction of embodiments as described herein is that a musician can choose standardized modular instrument components to customize the instrument. Another advantage of the modular soundboard 103 is that the musical instrument 100 is easy to repair due to ready access to the inside of the body 110. Further, various "extra" elements may be inserted in between the soundboard 103 and body 100. For example, a metal plate with holes at various positions can be installed to modify the sound. A spring can be installed between the top soundboard 103 and back 107 of the musical instrument 100, changing the interaction between the plates. "Antennae" can be placed stretching into the musical instrument 100, touching the soundboard 103, to provide buzzing sounds or to modify the tonality of the instrument 100. Microphones or other electronics can easily be installed in the instrument and later removed. All of these exemplary modifications and other modifications may be installed for special effects, then removed so that the instrument is put back to its original configuration.

Further, other instrument 100 modalities can be constructed on the soundboard 103, or different modular soundboards 103. For example, as described herein a mbira (or thumb piano) can be constructed on a soundboard so that it may use the existing body for resonance. A single body 103 can accommodate a steel-string soundboard 103, a nylon-string soundboard 103, or resonator-type guitar soundboard 103. In another embodiment, a single instrument body 110 can be configured for an archtop soundboard 103 (as for a violin or jazz guitar) and a flattop guitar soundboard 103.

For yet another advantage, an instrument 100 with a soundboard 103 or multiple soundboards can fit in a space only slightly larger than that needed for the instrument alone, allowing for travel or efficient storage.

While embodiments have been described using the example of guitars, embodiments include other stringed instruments with soundboards 103. For example, a removable soundboard can be configured for instruments including a guitar, a violin, a viola, a cello, a banjo, and other lute-type instruments.

Embodiments of the device can be made from materials that provide sufficient rigidity and resistance to stresses from repeated use. Exemplary materials include wood, metals, aluminum, titanium, plastics and reinforced plastics (e.g.

fiber reinforced polymers and laminates), MDF, carbon fiber and carbon fiber reinforced materials, and other such materials as known in the art.

While the foregoing written description of the invention enables one of ordinary skill to make and use embodiments thereof, those of ordinary skill will understand and appreciate the existence of variations, combinations, and equivalents of the specific exemplary embodiments and methods described herein. The invention should therefore not be limited by the above described embodiments and methods, but by all embodiments and methods within the scope and spirit of the invention as claimed.

What is claimed is:

1. A musical instrument comprising:

a body;

a soundboard;

a rim around a perimeter of an underside of the soundboard, wherein the rim is configured to allow the soundboard to detach from the body of the musical device, and wherein the rim comprises a width and a thickness configured to provide structural stiffness while still allowing a center of the soundboard to vibrate.

2. The musical instrument of claim 1:

wherein the rim comprises an attachment mechanism for attaching and detaching the soundboard from the body.

3. The musical instrument of claim 2:

wherein the attachment mechanism comprises fasteners selected from the group consisting of: nuts and bolts, buckles, magnets, pins, tabs and slots, and clamps.

4. The musical instrument of claim 3, wherein the attachment mechanism comprises nuts and bolts, and the musical device further comprises:

a plurality of bolt holes distributed along a frame of the body; and a plurality of corresponding nuts distributed in the rim of the soundboard.

5. The musical instrument of claim 4, wherein the bolt holes are configured to allow the plurality of bolts to extend through a frame from a top part of the instrument body to a bottom part of the instrument body.

6. The musical instrument of claim 5, wherein the instrument further comprises the bottom part attached to the frame on the opposite side of the soundboard, wherein the bottom part is configured to detach from the frame of the musical device.

7. The musical instrument of claim 3, wherein the attachment mechanism comprises nuts and bolts, and the musical device further comprises:

a plurality of bolts distributed along the rim of the soundboard and;

a plurality of corresponding nuts distributed in a frame of the body.

8. The musical instrument of claim 3, wherein the attachment mechanism comprises a plurality of buckles configured to buckle the rim and soundboard to a frame of the body.

9. The musical instrument of claim 3, wherein the attachment mechanism comprises a plurality of angled tabs distributed along the rim of the soundboard; and a plurality of mating slots distributed along a frame of the body.

10. The musical instrument of claim 2, wherein the musical instrument further comprises:

a frame of the body; and a rim formed on the frame of the musical instrument, wherein the rim on the underside of the soundboard is mountable on the rim formed on the frame.

11. The musical instrument of claim 10, wherein the rim formed on the frame of the musical instrument forms a side of the instrument body.

12. The musical instrument of claim 1, wherein the rim is configured to be mounted directly on a frame of the body of the musical device.

13. The musical instrument of claim 1, wherein the instrument further comprises a bottom part attached to the body on the opposite side of the soundboard, wherein the bottom surface is configured to detach from the musical device.

14. The musical instrument of claim 4, wherein the bolt holes are configured to allow the plurality of bolts to extend from a top of the instrument body to a bottom part of the instrument body.

15. The musical instrument of claim 1, wherein the rim is formed integrally with the soundboard.

16. The musical instrument of claim 1, wherein the rim is formed separately from the soundboard and attached thereto.

17. The musical instrument of claim 1, wherein the musical instrument is a lute type instrument selected from one of the group consisting essentially of: a guitar, a violin, a viola, a cello, a banjo, and a lute.

18. The musical instrument of claim 17, wherein the rim has a width extending from the side of the perimeter of the soundboard of up to about 2 inches and a thickness extending perpendicularly from the soundboard up to about 1 inch.

19. The musical instrument of claim 1, wherein the rim comprises a material selected from the group consisting essentially of wood, metal, medium-density fibreboard, plastic and carbon fiber.

20. The musical instrument of claim 2, wherein the perimeter of the soundboard forms the rim of the soundboard, and the musical instrument further comprises: a frame of the body; wherein rim reinforcement for the rim of the soundboard is provided by another rim formed on the frame of the musical instrument.

21. The musical instrument of claim 1, wherein the soundboard comprises a soundboard plate is selected from the group consisting of: a top part plate or a bottom part plate.

22. A soundboard for a musical instrument comprising:

a soundboard plate;

a rim around a perimeter of an underside of the soundboard plate, wherein the rim is configured to allow the soundboard to detach from a body of a musical instrument, and wherein the rim comprises a width and a thickness configured to provide structural stiffness while still allowing a center of the soundboard plate to vibrate.

23. The soundboard of claim 22:

wherein the rim comprises an attachment mechanism for attaching and detaching the soundboard from the body of the musical instrument.

24. The soundboard of claim 23:

wherein the attachment mechanism comprises fasteners selected from the group consisting of: nuts and bolts, buckles, magnets, pins, tabs and slots, and clamps.

25. The soundboard of claim 24, wherein the attachment mechanism comprises nuts and bolts, and the soundboard further comprises:

a plurality of nuts distributed in the rim of the soundboard and configured to mate with a plurality of bolts or bolt holes distributed along a frame of the body; or a plurality of bolts distributed along the rim of the soundboard configured to mate with a plurality of corresponding nuts distributed in a frame of the body.

26. The soundboard of claim 24, wherein the attachment mechanism comprises a plurality of buckles configured to buckle the rim and soundboard to a frame of the body.

27. The soundboard of claim 24, wherein the attachment mechanism comprises a plurality of angled tabs distributed along the rim of the soundboard configured mate with a plurality of mating slots distributed along a frame of the body.

28. The soundboard of claim 22, wherein the rim is configured to be mounted directly on a frame of the body of the musical instrument.

29. The soundboard of claim 22, wherein the rim is formed integrally with the soundboard plate.

30. The soundboard of claim 22, wherein the rim is formed separately from the soundboard plate and attached thereto.

31. The soundboard of claim 22, wherein the soundboard is configured for a lute type instrument selected from one of the group consisting essentially of: a guitar, a violin, a viola, a cello, a banjo, and a lute.

32. The soundboard of claim 31, wherein the rim has a width extending from the side of the perimeter of the soundboard plate of up to about 2 inches and a thickness extending perpendicularly from the soundboard plate up to about 1 inch.

33. The soundboard of claim 22, wherein the rim comprises a material selected from the group consisting essentially of wood, metal, medium-density fibreboard, plastic and carbon fiber.

34. A body for a musical instrument comprising:

a body comprising an attachment mechanism configured to attach and detach the detachable soundboard of claim 22.

35. The soundboard plate of claim 22, wherein the soundboard plate is selected from the group consisting of: a top part plate or a bottom part plate.

* * * * *